United States Patent [19]

Barton

[11] 4,029,111

[45] June 14, 1977

[54] ARTIFICIAL EYELINER AND EYELASH STRUCTURE

[76] Inventor: Barbara J. Barton, 4261 Cahuenga Blvd. Apt. 1, North Hollywood, Calif. 91602

[22] Filed: Sept. 29, 1975

[21] Appl. No.: 617,415

[52] U.S. Cl. ..... 132/53

[51] Int. Cl.[2] ..... A41G 3/00

[58] Field of Search ..... 132/53, 54, 5; 46/165

[56] References Cited

UNITED STATES PATENTS

| | | | |
|---|---|---|---|
| 1,897,747 | 2/1933 | Birk | 132/53 |
| 2,862,509 | 12/1958 | Porte | 132/53 |
| 3,266,500 | 8/1966 | Weld | 132/53 |
| 3,455,053 | 7/1969 | Pembor | 46/165 |
| 3,516,422 | 6/1970 | Bechtold et al. | 132/53 |

*Primary Examiner*—G.E. McNeill
*Attorney, Agent, or Firm*—William P. Green

[57] ABSTRACT

An eye make-up device which includes a group of natural or artificial hair filaments connected together and adapted to be applied to the eyelid of a wearer in a position of extension along the edge of the lid to serve as an eyeliner. This group of filaments is preferably attached to a series of eyelashes, which project from the group of filaments to form a composite eyeliner and eyelash unit.

14 Claims, 6 Drawing Figures

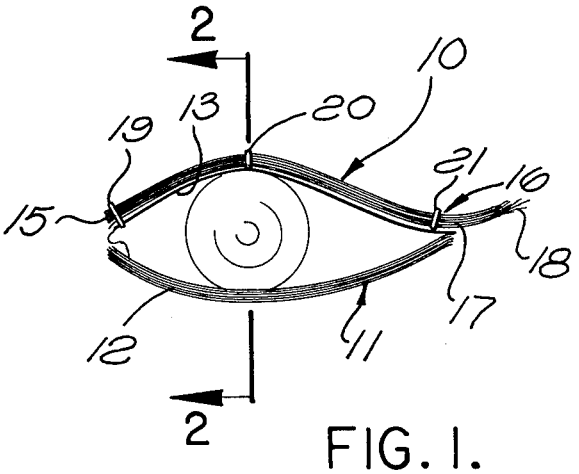
FIG. 1.
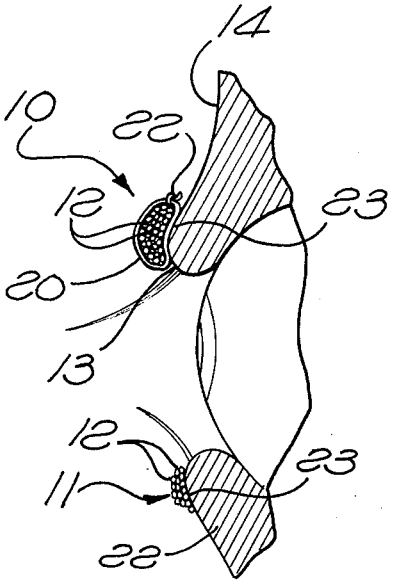
FIG. 2.
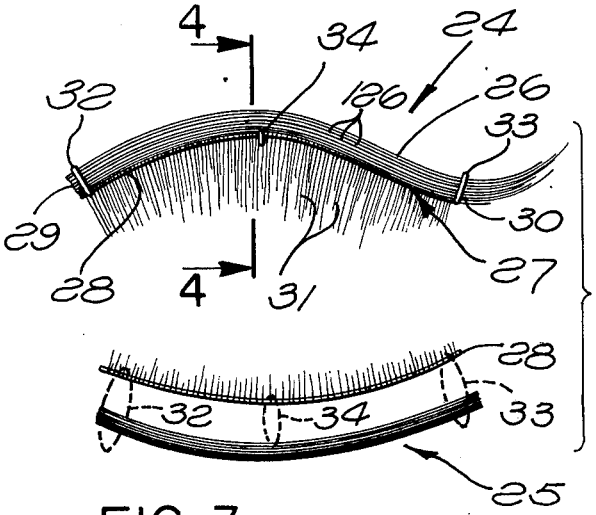
FIG. 3.
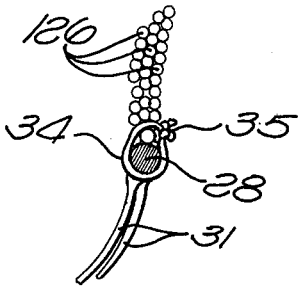
FIG. 4.
FIG. 5.
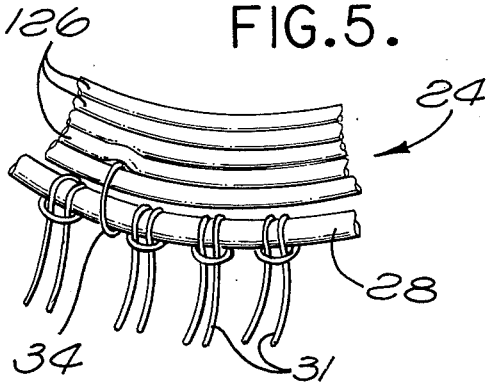
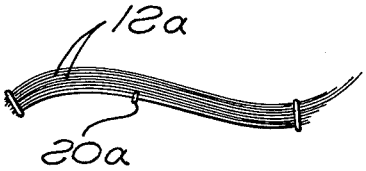
FIG. 6.

ARTIFICIAL EYELINER AND EYELASH STRUCTURE

BACKGROUND OF THE INVENTION

This invention relates to improved make-up units or devices to be applied to the eyelids of a wearer for the purpose of enhancing appearance of the eyes.

Many women, in making up their eyes, apply an 'eyeliner' to the eyelids to emphasize and improve the appearance of the eyes and eyelashes. This eyeliner consists merely of a line which is painted or penciled onto the eyelid, and extends along the edge of the eyelid at the base of the eyelashes.

One problem which is encountered universally among women with the use of such eyeliners resides in the tendency for the lining material to wipe off very easily, or be smudged over an increased area of the eye or surrounding facial tissue in a manner presenting a very unattractive appearance, and necessitating that the wearer very frequently check the appearance of her eyes and reapply eye make-up several times each day. In order to overcome this difficulty, there has been proposed in the past, in U.S. Pat. No. 3,266,500 issued Aug. 16, 1966, an aritificial eyeliner device consisting of a small piece of sheet material having adhesive on one surface adapted to be adhered to the eyelid of a wearer, with this piece of material being shaped to give the appearance of an eyeliner. The inventor in that patent also contemplated that artificial eyelashes might be carried by the eyeliner if desired.

SUMMARY OF THE INVENTION

The present invention provides a novel type of preformed eyeliner which, like that of the above mentioned patent, is adapted to be attached to the eyelid rather than painted or penciled onto it, and thereby avoids the smudging problem, but which it is felt presents a much more pleasing appearance than could be attained by the adhesive tape type structure of the patent, and gives the eye as a whole a much more natural overall appearance. In addition, an eye make-up device constructed in accordance with this invention can be secured to the eye in a manner leaving a greater freedom for circulation of air to the eyelid surface at a location of the eyeliner, to avoid any possibility of an adverse effect on the skin of the eyelid such as might occur if an adhesive tape element were applied to the skin.

A further object of the invention is to provide an improved combination eyeliner and eyelash device in which the liner portion of the device has the above discussed improved characteristics, and is secured to the artificial eyelash arrangement in a manner avoiding detraction from these characteristics in attaining an optimum composite assembly.

To attain these results, the eyeliner is formed of a group of natural hairs or artificial hair-simulating filaments which are connected together for handling as a unit, and are applied to the eyelid a wearer in a position of extension along the edge of the eyelid at the location at which an eyeliner is usually painted or penciled onto the lid. These natural or artificial hairs can be secured to the eyelid by adhesive, which is preferably applied at only certain spaced locations along the length of the group of hairs. The hairs may be secured together by means which leave the group of filaments exposed to view along the entire length or almost the entire length of the group. More particularly, a preferred arrangement for securing the hairs together is by providing elements looped about the group of hairs at spaced locations, desirably at their opposite ends and perhaps at an intermediate location, to avoid obstruction of the liner hairs from view except at these localized connecting points.

Artificial lashes may be secured to the group of liner hairs, with these lashes desirably being attached to an elongated carrier filament or element by being looped about that element, but with those loops of most and preferably all of the lashes not being disposed about or interfering with viewing of the discussed liner forming hairs.

BRIEF DESCRIPTION OF THE DRAWING

The above and other features and objects of the invention will be better understood from the following detailed description of the typical embodiment illustrated in the accompanying drawing in which:

FIG. 1 is a front view of upper and lower eyeliners constructed in accordance with the invention, as they appear in use when applied to the eye of a user;

FIG. 2 is a vertical section taken on line 2—2 of FIG. 1; FIG. 3 shows upper and lower combination eyeliner and eyelash assemblies embodying the invention;

FIG. 4 is an enlarged vertical section taken on line 4—4 of FIG. 3;

FIG. 5 is a fragmentary perspective view of a central portion of the upper eyelid device of FIG. 4; and FIG. 6 is a front view of another variational arrangement.

DESCRIPTION OF THE PREFERRED EMBODIMENTS

Referring first to the form of the invention shown in FIGS. 1 and 2, there are illustrated in those figures an upper eyeliner device 10 and a lower eyeliner 11 constructed in accordance with the invention. Each of these liners is formed of a group of elongated filaments 12, which may be natural hair or a substance such as an appropriate resinous plastic material simulating natural hair. All of these natural or artificial hairs in the two liner units 10 and 11 are of the same color, preferably corresponding to and preferably at least as dark as the color of the user's hair, though in some instances other colors may be employed. The hairs forming the upper liner 10 preferably extend paralled to one another and in use extend longitudinally along the edge 13 of the upper eyelid 14. These hairs of the top liner 10 may be preformed to have a natural curvature difining an upwardly arched curved shape of the type illustrated to which the liner 10 normally tends to return, with that curvature corresponding essentially to the curvature of the edge 13 of an upper eyelid. At the inner side of the eye (the left end in FIG. 1) all of the hairs 12 of the upper eyeliner 10 may terminate at a common location 15 corresponding to the inner extremity of the eyelid. At the opposite end of liner 10, the hairs 12 of that liner may form a portion 17 of the liner extending beyond the corner 16 of the eye and preferably having a natural upward curvature as shown. The hairs of this portion 17 may be cut off at different lengths to give a tapered or feathered appearance to this extension line gradually terminating at essentially a point at the location 18.

The hairs forming upper liner 10 are suitably secured together for handling as a unit, and for application to and removal from eyelid as a unit. For this purpose, the liner 10 may be a number of short pieces of hair or artificial hair 19, 20 and 21 looped about the group of hairs 12 at locations spaced along the length of hairs 12, and tied in knots to retain the hairs 12 in bundled relation and against separation from one another during handling. It is contemplated that there may in some instances be only two of these loops (19 and 21) near the opposite ends of the group of hairs 12, and if necessary in some instances a third such retaining element may be provided at essentially the center of the group of hairs 12, as shown at 20 in FIG. 1. FIG. 2 illustrates the manner in which each of these elements may be tied about the main bundle 12 of hairs, and be knotted at 22 for retention in the looped condition.

In lieu of the connecting loops 19, 20 and 21, the main longitudinal hairs 12 of the upper liner 10 may be secured together by other means, so long as the type of attachment employed is such as to leave the group of fibers 12 exposed to view along their entire length or almost their entire length, to give the desired optical appearance to the liner. One alternate method of attaching the hair 12 together is by utilizing an adhesive between the hairs securing them in the illustrated relationship but not covering their front sides or shielding them from view. The lower liner 11 of FIG. 1 is typically illustrated as formed in this manner, that is, by adhesive retention of the fibers 12 together without provision of the loops corresponding to those shown at 19, 20 and 21 in the upper liner. It will of course be understood, however, that the upper and lower liner of a pair or set will normally be formed in the same manner, and that the two different types of upper and lower liners are illustrated in FIGS. 1 and 2 only as a convenient way of showing two different possible variational arrangements.

In using the liners 10 and 11 of FIG. 1, they may be retained to the edges of the upper and lower eyelids 14 and 22 by application of adhesive to the back sides 23 of the liners. Preferably, this adhesive is applied only at certain spaced locations along the length of each liner, to leave the major portion of the eyelid free of adhesive and open to circulation of air behind and around the fibers 12. As an example, the upper liner 10 of FIG. 1 may be attached to the eyelid by adhesive at the locations of the three connecting loops 19, 20 and 21, and not therebetween or at the location of the laterally extending portion 17.

FIGS. 3 to 5 show a further variational arrangement in which an upper combined eyeliner and eyelash 24 and a lower combined eyeliner and eyelash 25 are provided. Describing first the upper unit 24, this includes an eyeliner 26 which may be formed of a group of natural or synthetic hairs 126 corresponding to those illustrated at 12 in FIGS. 1 and 2, and an eyelash assembly 27 secured to the underside of the group of liner hairs 26. The assembly 27 may be formed in approximately the same manner as most conventional eyelashes currently on the market, consisting of an elongated filament 28 extending longitudinally along the lower edge of the group of liner fibers 126, between the locations 29 and 30 of FIG. 3, with lash hairs 31 being attached to filament 28 and projecting therefrom to form artificial eyelashes. The method of attachment of the lash hairs 31 to carrier filament 28 may be by conventional loop or slip type knots, as illustrated in FIG. 5. More particularly, each elongated lash hair may be doubled back on itself to form a return bend at 32, with the opposite ends of the lash hair being wound about carrier filament 28 and then passed through the return bend loop 32 to form a tight attachment ot filament 28. This type of attachment is illustrated in U.S. Pat. Nos. 1,897,747 and 3,880,175, in the former of which it is stated that the carrier filament corresponding to the element 28 of of the present FIG. 5 can be either one individual fiber or a plurality of fibers.

After the artificial eyelash assembly 27 has been formed as described from the carrier filament 28 and lash hairs 32, this assembly is attached to the lower edge of the group of hairs forming liner 26. Such attachment may be in any apprppriate manner, as by adhesive or the like, but preferably is attained by provision of a plurality of connecting hairs or filaments 32, 33, and 34, looped about both the liner hairs 126 and the elongated filament 28 which functions as the carrier of the eyelash assembly, to serve both as the connector for securing together the individual liner hairs, and the connector for securing the liner to the eyelash assembly. As in the case of the arrangement of FIGS. 1 and 2, these connector hairs 32, 33 and 34 are knotted at 35 (FIG. 4) to retain them about the connected parts. The two connector loops 32 and 33 may be located near opposite ends of the assembly, at positions corresponding to elements 19 and 21 of FIG. 1, while the third connector 34 may be provided at an intermediate or central location. Desirably, this central connector 34 is not looped about all of the hairs 126 of the liner, but rather extends about only one or a few of those hairs in addition to the lash carrier filament 28, to secure the lash assembly in place while avoiding any obstruction at all of most of the hairs 126. The lower liner 25 of FIG. 3 may be constructed the same as the above liner, and is illustrated in exploded form in FIG. 3 in order to further clarify the construction of the combination liner and lash units.

The combined units 24 and 25 of FIGS. 3 to 5 are applied to the eyelids in the same manner discussed in connection with the liners of FIGS. 1 and 2, that is, by application of adhesive to the back sides of the assemblies 24 and 25, preferably only at a few longitudinally spaced locations (say for example at the locations of the three connector loops 32, 33 and 34).

FIG. 6 illustrates a variational eyeliner arrangement which may be the same as the upper liner FIG. 1, except that the central connector loop 20*a* of FIG. 6 extends about only some but not all of the liner hairs 12*a* (two or more of those hairs) in a manner similar to loop 34 of FIG. 5, thus leaving most of the hairs 12*a* completely exposed and free of any direct attachment at that central location.

In all forms of the invention, the hairs 12 or 126 extending longitudinally along edges of the eyelids give an appearance corresponding to that which is normally sought by the use of painted or penciled eyeliners, but does so in a much more pleasing manner, without danger of smudging, and with a permanence enabling the units to be used for extended periods of time without the necessity for frequent repair jobs to the eye makeup. The presence of the eyeliner adjacent the natural and/or artificial eyelashes enhances the appearance of those lashes and makes them seem thicker and more beautiful. In addition, because the liners are actually formed of hairs rather than merely painted lines or tape, the overall visual effect is a more natural one.

In those forms of the invention in which the eyeliner hairs are secured together by loops disposed about the hairs, as at 19, 20 and 21 in FIG. 1 or at 32, 33 and 34 in FIG. 3, as well as in FIG. 6, it is contemplated that any convenient type of knot may be employed to hold the loops about the hairs. As an example of one possible variation which might be utilized, the loops 19, 20, etc. could easily be formed as slip type knots similar to those which are employed in FIG. 5 for attaching the lashes 31 to carrier 28.

If an adhesive is substituted for the loops 19, 20, 21, 33, 34, 35, etc. of the various forms of the invention, that adhesive may be applied either along the entire length of the liner hairs, or only at spaced localized points corresponding to the positions of the loops in the different figures. In the latter event, the adhesive at the locations of the end loops (32 and 33 in FIG. 3) may secure all of the hairs of the liner together at those locations, while the adhesive at the location of the central loop (34 in FIG. 3 or 20*a* in FIG. 6) may secure only one or a few (and not all) of the hairs 126 to lash carrier 28 in FIG. 3, or secure less than all of the liner hairs in FIG. 6 together.

While certain specific embodiments of the present invention have been disclosed as typical, the invention is of course not limited to these particular forms, but rather is applicable broadly to all such variations as fall within the scope of the appended claims.

I claim:

1. An eye make-up device comprising:

an elongated eyelash carrier;

a series of artificial eyelashes forming loops extending about said carrier at different locations along its length and projecting generally transversely therefrom;

a bundle of natural hair or artificial hair-simulating filaments extending generally parallel to and near said eyelash carrier at the outside of said loops formed by said eyelashes; and means connecting said carrier and said bundle filaments together for handling as a unit and for attachment as a unit to the eyelid of a user in a position of extension longitudinally along the edge of the eyelid, with said bundle of filaments being exposed to view and being wide enough to serve as a readily visible eyeliner accentuating the appearance of the eyelashes.

2. An eye make-up device as recited in claim 1, in which said eyelash carrier and said filaments have a normal curvature corresponding generally to the curvature of the edge of an eyelid.

3. An eye make-up device as recited in claim 1, in which said connecting means include elements looped about and securing together said carrier and said bundle of filaments at different longitudinally spaced locations.

4. An eye make-up device as recited in claim 1, in which said connecting means include two elements looped about and securing together said carrier and said bundle of filaments near opposite ends thereof, and at least one additional element looped about and securing together said carrier and bundle of filaments at a location intermediate said two first mentioned elements.

5. An eye make-up device comprising:

an elongated eyelash carrier;

a series of artificial eyelashes forming loops extending about said carrier at different locations along its length and projecting generally transversely therefrom;

a bundle of natural hair or artificial hair-simulating filaments extending generally parallel to and near said eyelash carrier at the outside of said loops formed by said eyelashes; and means connecting said carrier and said bundle of filaments together for handling as a unit and for attachment as a unit to the eyelid of a user in a position of extension longitudinally along the edge of the eyelid, with said bundle of filaments being exposed to view and being wide enough to serve as a readily visible eyeliner accentuating the appearance of the eyelashes;

said connecting means including two elements looped about and securing together said carrier and said bundle of filaments near opposite ends thereof, and a third element extending about and securing together said carrier and at least one but not all of said filaments of said bundle at a location intermediate said two first mentioned elements.

6. An eye make-up device comprising:

an elongated eyelash carrier;

a series of artificial eyelashes forming loops extending about said carrier at different locations along its length and projecting generally transversely therefrom;

a bundle of natural hair or artificial hair-simulating filaments extending generally parallel to and near said eyelash carrier at the outside of said loops formed by said eyelashes; and means connecting said carrier and said bundle of filaments together for handling as a unit and for attachment as a unit to the eyelid of a user in a position of extension longitudinally along the edge of the eyelid, with said bundle of filaments being exposed to view and being wide enough to serve as a readily visible eyeliner accentuating the appearance of the eyelashes;

said bundle of filaments having portions which project beyond the eyelashes and which are feathered so that different ones of the filaments have different lengths to progressively reduce the size of the bundle as it approaches its extremity.

7. An eye make-up device comprising:

a bundle of natural hair or artificial hair-simulating filaments extending essentially parallel to one another and in close proximity and adapted and dimensioned to be attached to the eyelid of a user in a position of curving extension as a bundle longitudinally along the edge of the eyelid; and means connecting said filaments together for handling and application to the eyelid as a unit;

said connecting means and the remainder of said device being constructed to leave said bundle of filaments exposed to view along the entire or almost the entire length of the bundle and eyelid, and to leave individual filaments of the bundle exposed to view continuously and without interruption along extended distances many times as great as the diameter of the individual filaments;

said bundle of filaments being wide enough to function effectively as a readily visible eyeliner defining said edge of the eyelid.

8. An eye make-up device as recited in claim 7, in which said connecting means include elements looped about and securing together said bundle of filaments at different longitudinally spaced locations and leaving the filaments exposed for said extended distances therebetween.

9. An eye make-up device as recited in claim 7, in which said connecting means include adhesive securing said filaments together but leaving said bundle exposed for said extended distances.

10. An eye make-up device as recited in claim 7, in which said bundle of filaments is shaped to have a curvature corresponding essentially to the normal curvature of the edge of an eyelid.

11. An eye make-up device as recited in claim 7, including a series of artificial eyelashes projecting from said bundle of filaments generally transversely of the length of the filaments.

12. An eye make-up device as recited in claim 7, in which said connecting means include two loops extending about and securing together the filaments of said bundle near opposite ends thereof, and at least one additional loop encircling the bundle of filaments and securing them together intermediate said first mentioned two loops.

13. An eye make-up device comprising:

a bundle of natural hair or artificial hairsimulating filaments extending essentially parallel to one another and in close proximity and adapted and dimensioned to be attached to the eyelid of a user in a position of curving extension as a bundle longitudinally along the edge of the eyelid; and means connecting said filaments together for handling and application to the eyelid as a unit;

said bundle of filaments having an end at which the individual filaments thereof terminate at different locations in feathered relation so that said end of the bundle gradually reduces in size in approaching its extremity.

14. An eye make-up device comprising:

a bundle of natural hair or artificial hairsimulating filaments extending essentially parallel to one another and in close proximity and adapted and dimensioned to be attached to the eyelid of a user in a position of curving extension as a bundle longitudinally along the edge of the eyelid; and means connecting said filaments together for handling and application to the eyelid as a unit;

said connecting means and the remainder of said device being constructed to leave said bundle of filaments exposed to view along the entire or almost the entire length of the bundle and eyelid, and to leave individual filaments of the bundle exposed to view continuously and without interruption along extended distances many times as great as the diameter of the individual filaments;

said bundle of filaments being wide enough to function effectively as a readily visible eyeliner defining said edge of the eyelid;

said connecting means including two loops extending about and securing together the filaments of said bundle near opposite ends thereof, and a third loop encircling some but not all of said bundle of filaments and securing them together at a location intermediate said first mentioned two loops.

* * * * *